United States Patent [19]

Guillermin et al.

[11] 4,020,196

[45] Apr. 26, 1977

[54] PROCESS FOR TREATING FILAMENTARY PRODUCTS

[75] Inventors: René Guillermin, Bron; Jean Joly, Craponne; Sylvio Sangalli, Caluire, all of France

[73] Assignee: Rhone-Poulenc-Textile, Paris, France

[22] Filed: June 5, 1975

[21] Appl. No.: 583,914

[30] Foreign Application Priority Data

June 10, 1974 France ..... 74.20253

[52] U.S. Cl. ..... 427/248 G; 8/149 L; 8/158; 427/170; 427/175; 427/434 C; 427/434 D

[51] Int. Cl.[2] ..... D06B 3/06; B05D 1/18

[58] Field of Search ..... 427/170, 174, 175, 248 G, 427/434 L, 434 D; 118/411, 420, 48; 8/147, 149.2, 158, 149.3

[56] References Cited

UNITED STATES PATENTS

| | | | |
|---|---|---|---|
| 3,393,661 | 7/1968 | Sharp | 118/411 |
| 3,422,796 | 1/1969 | Baber | 118/411 |
| 3,511,730 | 5/1970 | Carder | 118/411 X |

*Primary Examiner*—James R. Hoffman
*Attorney, Agent, or Firm*—Sherman & Shalloway

[57] ABSTRACT

A process for treating filamentary products, such as yarn, includes advancing the yarn in a groove, which has orifices opening in the bottom thereof, and which communicate with a channel through which a fluid is expelled. The fluid supports the strand so that the yarn does not touch the groove. In addition, the fluid treats the yarn and helps to advance the yarn.

5 Claims, 9 Drawing Figures

PROCESS FOR TREATING FILAMENTARY PRODUCTS

BACKGROUND OF THE INVENTION

1. Field of the Invention

The present application relates to a process for treating textile fibers and an apparatus for carrying out the process.

2. Technical Considerations and Prior Art

For certain treatments of textile fibers, one uses either chambers of large size, which are bulky and require constant maintenance, or devices which are in contact with the yarns which increase in size with the length of the treatment time of the yarn.

The treatment performed in contact with a surface, which is generally hot, has two main disadvantages. Firstly, there is friction between the stretched yarn and the device (which may be, for example, a heating drum or a heating plate). Secondly, there is non-uniformity of the treatment of the yarn at any one instant, because only one face of the yarn is in contact with the device; the other face being in the surrounding atmosphere.

Prior art approaches which may be of interest, and over which the instant invention distinguishes, include U.S. Pat. Nos. 3,393,661; 3,422,796 and 3,511,730 and French Pat. No. 1,357,993.

SUMMARY OF THE INVENTION

The present invention makes it possible to avoid the afore-mentioned disadvantages. According to the present invention, contact of the yarn with the treatment apparatus is avoided.

The present invention contemplates a process for treating at least one moving yarn, characterized in that the yarn passes, through a treatment zone consisting of a groove which is pierced with at least one orifice, through which is introduced a fluid for treating the yarn and keeping the yarn suspended.

The present invention also contemplates an apparatus for the treatment of at least one moving yarn by a fluid, characterized in that it consists of at least one static hollow solid, having a surface which includes and defines at least one groove for the yarn to pass through. The bottom of this groove is pierced with at least one orifice through which a fluid under pressure passes from the interior to the exterior of the solid. At least one means is provided for supplying the fluid. The fluid, which is introduced under pressure, can be a gas, a liquid or a vapor. If it is a liquid, the liquid can be a dyestuff, a size, water or the like. The fluid may or may not contain a filler for sanding. The fluid may be supplied at a desired temperature, and may be heated inside the apparatus by suitable means. The groove into which the fluid is introduced, and which contains the yarn, can have any suitable profile. The groove may or may not be at right angles to the axis of the apparatus and the maximum depth of the groove is at least equal to the diameter of the yarn. The solid is preferably, but not necessarily, a volume of revolution such as a straight cylinder, truncated cone or prismatic cylinder. In this case, the solid includes at least one groove over at least a part or all of its circumference.

DETAILED DESCRIPTION

Figure 1:
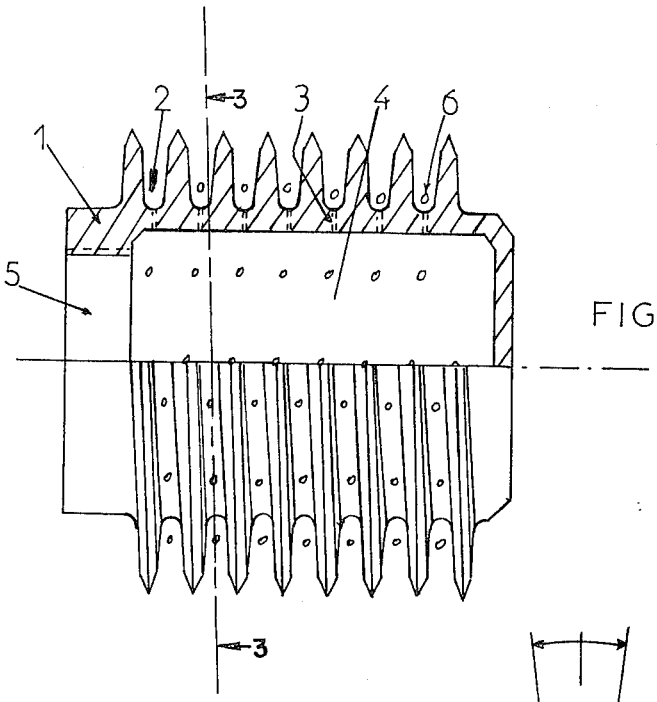
FIG. 1 shows a partial cross-section of a treating cylinder, according to the present invention, with a helically arranged groove therearound.

In FIG. 1, there is shown an apparatus 1 in the shape of a straight cylinder, having a groove 2 arranged in the form of a helix and executing seven turns. In the bottom of the groove 2, there are orifices 3 distributed uniformly over the circumference of the cylinder. The apparatus or cylinder 1 is hollow and forms a chamber 4 which receives a fluid under pressure through an orifice 5. The fluid comes from a source of supply which is not shown.

Figure 2:
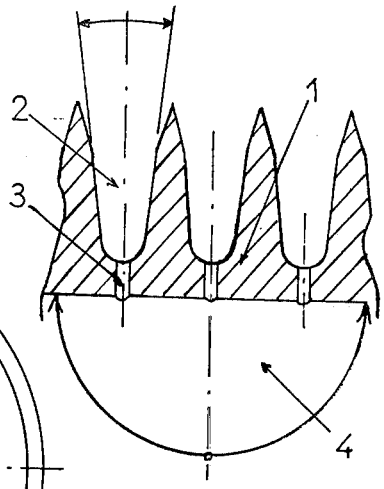
FIG. 2 is an enlarged cross-section of a portion of FIG. 1, showing a detailed view of the groove.

In FIG. 2, there is shown the channel of groove 2, the orifices 3 and a part of the apparatus 1 with the associated internal chamber 4.

Figure 3:
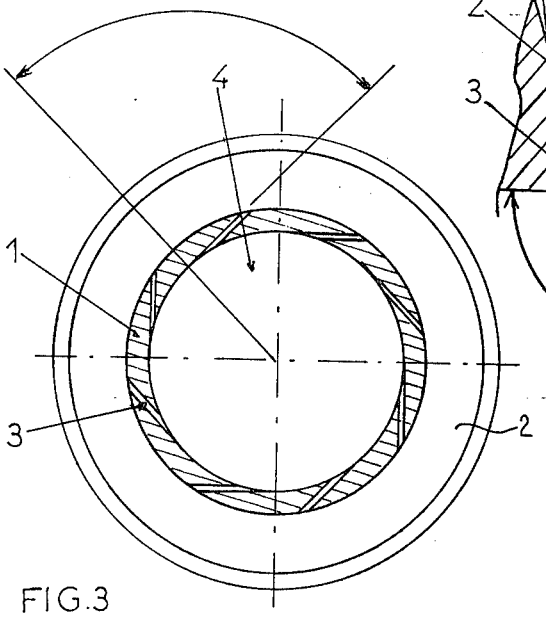
FIG. 3 is a cross-section of FIG. 1 taken along lines 3—3.

Referring to FIG. 1, in carrying out the process a fluid is introduced under pressure into the chamber 4 of the apparatus 1, from where it escapes through the orifices 3 and channels into the groove 2, where it encounters a moving yarn. The fluid maintains the yarn in suspension, without friction against the walls of the groove 2 or surfaces defining the groove while treating the yarn. The number of orifices 3 can be varied, and the introduction of the fluid from the channel into the groove is either radial or nearly tangential relative to the interior of the cylinder 1. For example, in FIG. 3, the cross-section of a groove with nearly tangential introduction of the fluid relative to the interior wall of the cylinder 1 is shown. In this case, the fluid treats the yarn, keeps it in suspension and also assists its travel by having a tangential component relative to the groove 2. The diameter and shape of the orifices 3 can be varied from one groove to the other and within the same groove. If desired, it is possible to allow two different fluids or the same fluid at different temperatures to issue through two successive orifices. In addition, the interior of the apparatus can contain means for blocking certain orifices depending on the use to which the apparatus is put as is seen in FIG. 3, the groove 2 defines a helical path in that the groove surrounds the cylinder 1.

Depending on the desired treatment, one or more cylinders 1 can be used. The treatment by means of the apparatus including the cylinders 1 can be carried out alone or in combination with other treatments using other apparatuses (for example, false twist apparatus). The fluid is introduced at any desired pressure depending on the treatment to which the yarn is to be subjected. The speed of travel of the yarn also depends on the desired treatment.

By "yarn", it is to be understood to include any continuous filament, spun fiber yarn or sliver which may or may not be in a crimped or compressed form.

Among the treatments which can be carried out by means of the apparatus of the present invention, there may be included heat treatments to cause stabilization or relaxation, sizing, fixing or cooling treatments, spraying with particles or the like.

Figure 9:
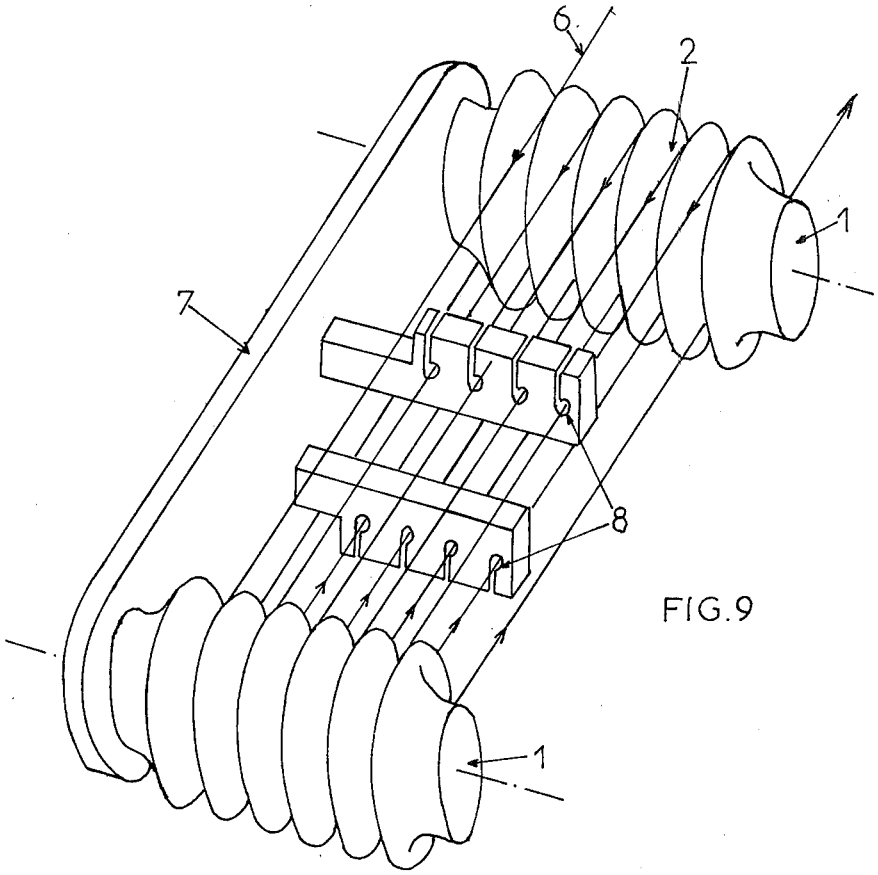
FIG. 9 is an isometric view showing a pair of treatment cylinders treating yarn.
Figures 4, 5, 6, 7, 8:
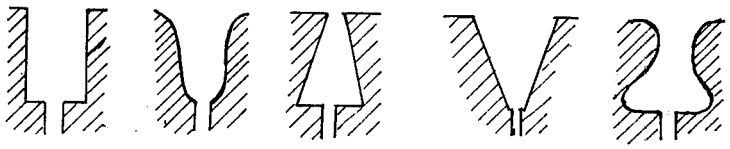
FIGS. 4 through 8 are enlarged cross-sections of the groove, showing various configurations for the groove.

The apparatus of the instant invention permits heat treatment of long lengths of yarn within a limited space. Thus, as shown in FIG. 9, two cylinders 1 are used for heat treatment of the yarn 6 which passes through two sets of false twist nozzles 8. In this case, the orifices 3 in the internal faces of the grooves may be blocked. The two cylinders are mounted on a support 7.

In operation, the yarn is hooked up to a take-up or winding device and the fluid pressure in the chamber 4 is increased to suspend and advance the yarn. The take-up then winds the yarn-up in a conventional way, as the yarn is advanced.

EXAMPLE

The present example describes the relaxation heat treatment of a multifilament yarn of 2,300 dtex/136 strands, texturized by the process described in U.S. Pat. No. 3,703,754, in which after texturizing, the compression effect is eliminated by subjecting the yarn to relative tension by passing it between two rollers. The treated yarn is then wound up on a bobbin. The yarn is used for the manufacture of needle-punched or tufted carpets, in which it is desirable for the loop formed by the pile to have good elasticity, good covering power, a high crimping bulk and low dimensional shrinkage so as to preserve a good definition of the pattern in use.

The yarn passes over a spirally grooved cylinder 1, such as that shown in FIG. 1. The groove is arranged in the form of an endless screw. The speed of travel of the yarn in the groove is 900 meters/minute, the pressure of the steam introduced into the apparatus is 8 kg/cm$^2$ and the temperature of the steam introduced is 280° C; the spiral is located between two stations for subjecting the yarn to relative tension, and the yarn is thereafter wound up at about 850 meters/minute.

The table which follows gives a comparison of the results obtained on a texturized yarn with and without using the apparatus according to the instant invention. The amount of tension applied or stretch is 6% in both cases.

| | Without the apparatus | With the apparatus |
|---|---|---|
| Yarn gauge | 2870 dtex/136 strands | 2900 dtex/136 strands |
| Shrinkage in boiling water | 1.4% | 0.25% |
| Shrinkage in steam at 130° C | 2.2% | 0.67% |
| Contraction of crimp in water at 60° C (FElting capacity) | 29.5% | 14% |
| Elasticity | 13% | 16% |
| Bulk | 3.2 cm$^3$/g | 3.77 cm$^3$/g |
| Crimps, ½ wave/cm | 7 | 10.3 |

The yarn treated with this apparatus satisfactorily exhibits the properties required for producing a tufted fabric, the design of which does not have a felted appearance and which will therefore retain good definition during use.

In as much as the present invention is subject to many variations, modifications and changes in detail, it is intended that all matter described above or shown in the accompanying drawing be interpreted as illustrative and not in a limiting sense.

What is claimed is:

1. A process for treating at least one moving textile yarn in a treatment zone including surfaces which define at least one groove wherein the groove is pierced with at least one orifice, through which a treatment fluid is introduced, and wherein the improvement resides in the simultaneous steps of advancing the yarn through the treatment zone, while treating the yarn with the fluid and suspending the yarn in the fluid so that the yarn does not engage the surfaces defining the groove.

2. A process for the treatment of at least one moving textile yarn according to claim 1, wherein the fluid used is a gaseous fluid.

3. The process of claim 1, wherein the advancing step is accomplished by directing the fluid in a direction having a component in the direction of advance so as to entrain the yarn in the fluid and thereby advance the yarn.

4. The process of claim 3, wherein the groove defines a helical path and there are a plurality of orifices in the groove disposed to direct the fluid with a tangential component relative to the helical path.

5. The process of claim 3, wherein the fluid is a gaseous fluid.

* * * * *